United States Patent [19]

Dalle et al.

[11] 3,994,147

[45] Nov. 30, 1976

[54] INSTALLATION FOR TREATING TEXTILE MATERIALS IN THE FORM OF SLIVERS OR ROVINGS OF FIBERS WITH A LIQUID

[75] Inventors: Jean-Paul Dalle; Jacques Vancraeyneste, both of Saint-Quentin, France

[73] Assignee: OPI Cryochimie, Saint-Quentin, France

[22] Filed: Apr. 10, 1975

[21] Appl. No.: 566,818

[52] U.S. Cl. ..... 68/22 R; 68/178; 68/205 R; 19/160; 226/118; 270/79

[51] Int. Cl.[2] ..... D06B 1/02; D06B 23/16

[58] Field of Search ..... 68/175, 177, 178, 179, 68/62, 205 R, 22 R; 26/21; 19/160; 270/61 F, 73, 79; 226/118

[56] References Cited

UNITED STATES PATENTS

| | | | |
|---|---|---|---|
| 1,074,568 | 9/1913 | Gantt | 68/178 |
| 1,180,267 | 4/1916 | Palmer | 68/178 X |
| 1,209,880 | 12/1916 | Palmer | 68/178 |
| 1,778,380 | 10/1930 | Conrad | 68/178 X |
| 3,019,631 | 2/1962 | Freyberg | 68/178 |
| 3,351,992 | 11/1967 | Carter | 19/160 X |
| 3,510,251 | 5/1970 | Fujii et al. | 68/178 X |
| 3,526,106 | 9/1970 | Kennedy et al. | 68/178 X |
| 3,593,546 | 7/1971 | Hasegawa et al. | 68/178 |

*Primary Examiner*—Philip R. Coe
*Attorney, Agent, or Firm*—Curtis, Morris & Safford

[57] ABSTRACT

Apparatus for treating textile materials particularly in the form of slivers or rovings of cellulosic materials and the like with a liquid while not under tension. The preferred apparatus consists of a long, narrow, and deep treatment enclosure into which the slivers are fed by a roller feed mechanism which also incorporates a spray device for impregnating the slivers passing therethrough with a treating liquid. The feed device lays the slivers into the enclosure in folds laid along the length of the enclosure as the feed device moves back and forth along the enclosure's length. The treatment enclosure preferably curves into a horizontal section having a drain at the bottom for drawing off the excess treating liquid. The interior of the treatment enclosure is formed of a relatively frictionless material to facilitate the sinking of the treated material continuously from the vertical through the curved section to the short horizontal section, from which latter the sliver is then drawn out of the enclosure by a take up device formed of two identical motor driven ridged rollers (first passing through driven wringing rollers, which latter extract more of the treating liquid). From there the treated sliver is preferably laid on a conveyor passing through a conventional oven.

11 Claims, 4 Drawing Figures

INSTALLATION FOR TREATING TEXTILE MATERIALS IN THE FORM OF SLIVERS OR ROVINGS OF FIBERS WITH A LIQUID

The present invention relates to an installation for treating materials in the form of slivers or rovings of fibers with a liquid, the materials being more particularly textile materials such as cellulose materials or wool. Materials of a similar nature to textile materials, such as glass fibers, also fall within the scope of the present invention.

The treatment of textile materials often calls for them to be brought into contact with a liquid for a longer or shorter period of time. Such treatments have for long been carried out by non-continuous methods such as by treating threads on reels or in hanks and by treating fabrics in piece form. Attempts have increasingly been made to carry out the treatments by continous methods. It is now known to treat fabrics in devices called J-boxes which are formed by a J-shaped container. The fabrics drop into the longer arm of the J in folds on pleats and are withdrawn from the upper end of the shorter arm.

Attempts have been made to use J-boxes to treat material in the form of slivers or rovings of fibers. Such treatment would be attractive for the following reasons:

a. high productively due to the high weight per unit length of material:
b. the possibility of treating the material in a relaxed state:
c. the possibility of removing irregularities which might exist by mixing a number of slivers, and finally:
d. the possibility of treating fibers whose final destinations are very different on one machine.

In fact the turn by the material into the second vertical arm causes a considerable amount of tangling. It is found to be virtually impossible to disentangle a sliver after it has passed through a J-box.

It is an object of the invention to provide an installation which enables any material which takes the form of slivers or rovings of fibers to be treated continuously in the relaxed state.

Accordingly, the invention consists in an installation for treating textile materials, in the form of slivers or rovings of fibers, with a liquid while not under tension, consisting of a treatment enclosure, a device for feeding the material into said enclosure, means for impregnating the material with the treating liquid, and a device for withdrawing the material from the treatment enclosure, said treatment enclosure, said treatment enclosure being formed by a substantially vertical section into which the material is fed, which is followed by a substantially horizontal section from which the material is withdrawn.

Withdrawal from the horizontal chamber may take place in a substantially horizontal direction, or else in a positive oblique direction which makes a considerable angle with the vertical direction. By "positive" is meant that the angle of withdrawal is acute to the horizontal discharge.

In order to recover a porportion of the liquid carried along with the material, the bottom of the horizontal chamber may be perforated so as to form a sump to drain the material.

The device for feeding in the material is preferably formed by a movable housing and two take-up rollers one of which is driven round and the other of which is mounted to rotate freely and is held pressed against the first roller. The device may also also include sleeves for guiding the material above and below the rollers.

In order to ensure that the material is properly impregnated, the impregnation means may comprise nozzles which are uniformly distributed around the area in which the material passes through the infeed device.

In order that the invention may be more clearly understood, reference will now be made to the accompanying drawings which show one embodiment thereof by way of example and in which.

Figure 1:
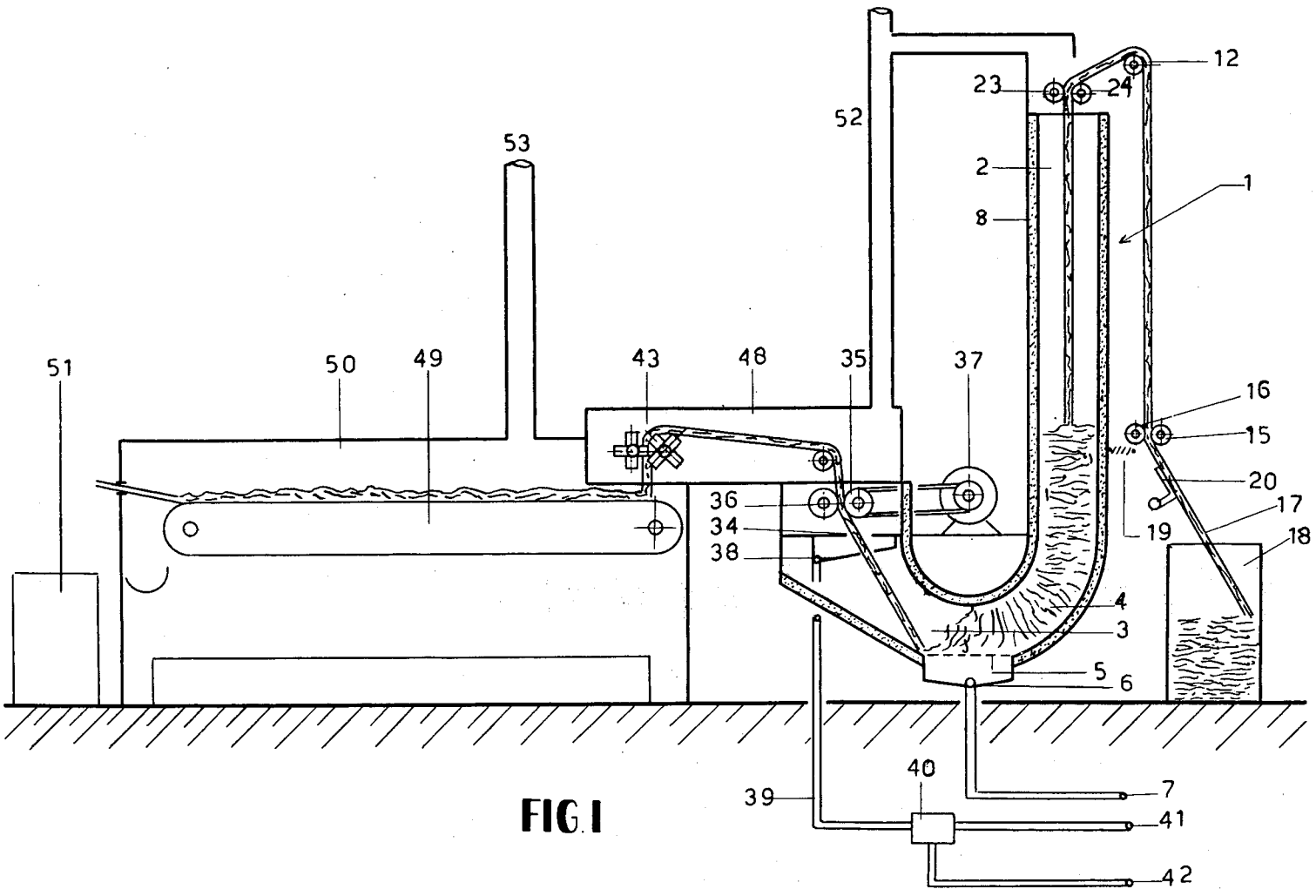
FIG. 1 is a schematic elevation view of the selected embodiment of installation according to the invention.
Figure 2:
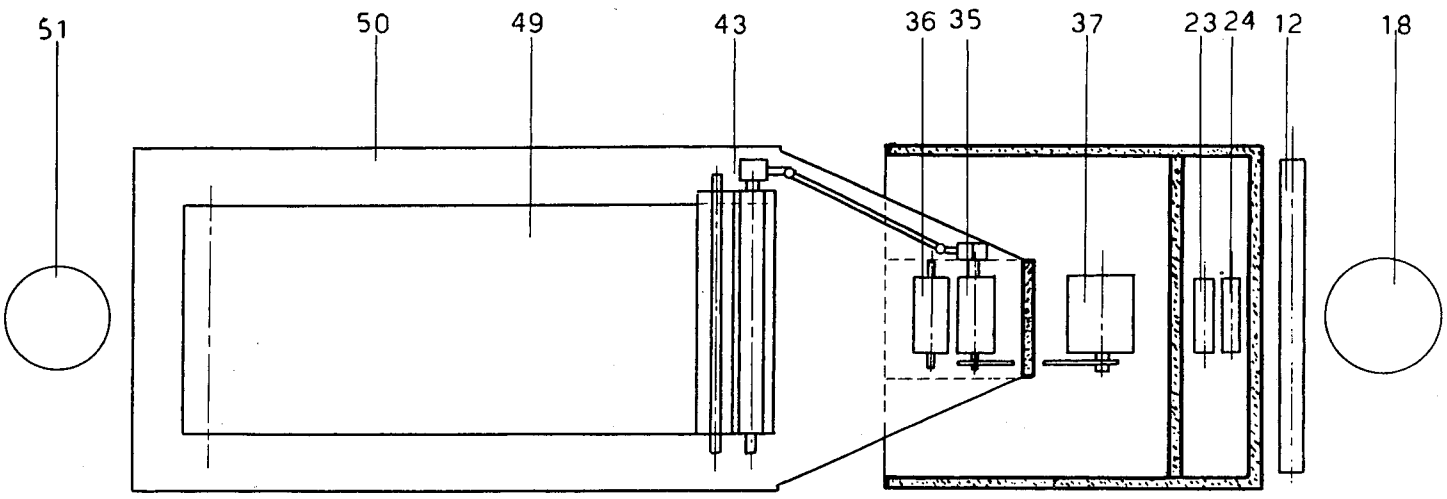
FIG. 2 is a plan view of the installation of FIG. 1.

Referring to FIGS. 1 and 2, it can be seen that the installation consists mainly of a treatment enclosure 1 into which the sliver to be treated is introduced. This enclosure is formed by a vertical section 2 and a substantially horizontal section 3. It may be made from any suitable material such as stainless steel, which is compatible with the product to be treated and the treating agent.

These two principal sections are connected by a section 4. In order to make it easier for the material to slide, this section 4 may be given a radiused shape. It may also be made from a material which makes sliding easier or it may be coated internally with a film of such a material, such as suitably worked stainless steel, polyethylene, ethylene polytetrafluoride, etc. The enclosure may be of any cross-sectional shape whatever but a rectangular shape makes the installation easier to operate, as will be seen below.

The bottom horizontal wall 5 of section 3 is perforated so as to provide drainage for the material being treated. Underneath this wall is situated a trough 6 for collecting the treating liquid, which is connected to a pipe 7 through which the liquid collected is returned to a storage vessel (not shown) from which point it is recycled. In the embodiment illustrated in FIG. 1, the horizontal section is very short. The upper wall of the horizontal section has been given a radiused outline shape solely to make it easier to manufacture in practice.

In FIG. 1, it can be seen that the treatment enclosure is fully insulated by an external covering 8. If the treatment to be carried out does not call for any definite temperature and can be carried out at ambient temperature, the heat insulation may advantageously be dispensed with.

Figure 3:
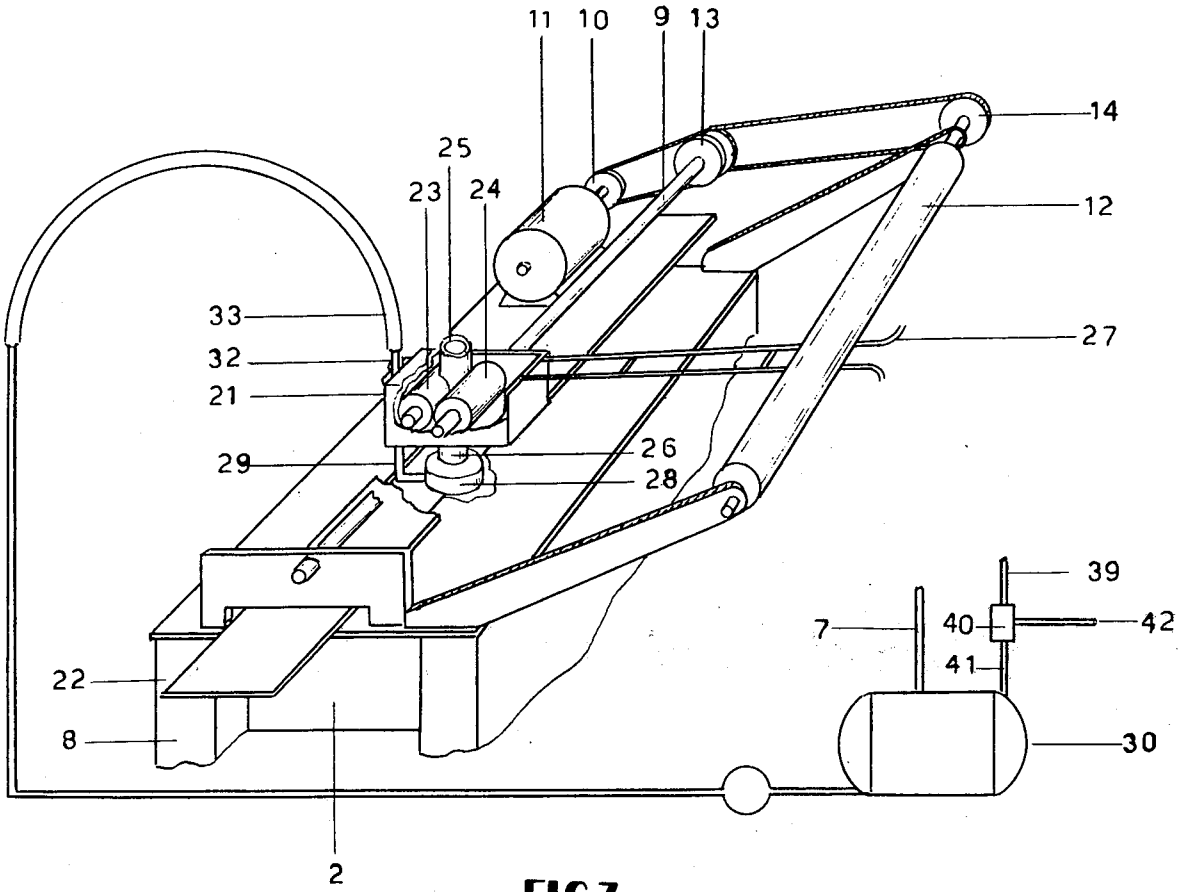
FIG. 3 is a perspective view of the device for feeding in the material.

Above the upper opening of the enclosure 1 is situated a device for feeding in the silver, which is shown in detail in FIG. 3. The device has a horizontal shaft 9 the axis of which coincides the axis of the enclosure. This shaft is driven round, via gears 10, 13, by a variable speed motor 11. A guide roller 12, which is parallel to shaft 9, is mounted upstream of the latter shaft on the framework of the installation. This roller 12 also is driven round from motor 11 by means of the gears 13 and 14 which are linked to shaft 9.

A housing 21 is mounted to slide on shaft 9.

It is driven along the shaft with a reciprocating motion by a traversing system (not shown) which may be of any known type and may for example be a set of pinions and an endless chain to which the housing is attached. In order to restrict the opening to free air of the enclosure, while at the same time allowing housing 21 to move, the lower part of the housing is formed by a plate 22 the width of which is substantially the same as that of the enclosure and the length of which is adequate to close off the opening at the top of the enclosure whatever the position of housing 21 along shaft 9.

Inside the housing are two rollers 23 and 24 one of which, being connected to shaft 9, is driven round and the other of which is mounted to rotate freely and is held pressed against the first roller. Above the rollers is situated a guide sleeve 25 the outline shape of which is substantially cylindrical and then tapering so as to rest accurately against rollers 23 and 24. Beneath the rollers is situated an identical guide sleeve 26. Also, there is attached to the upper part of of the housing a fork 27 the two prongs of which pass under guide roller 12 and serve to communicate the reciprocating movement of the housing 21 to the sliver. Underneath the housing is attached a hollow annular member 28 which extends around the outlet from sleeve 26. This member, which is connected by a pipe 29 to the source of the supply of treating liquid (which is shown schematically at 30), has a set of internal nozzles which are regularly distributed around the inner circumference of the outlet from sleeve 26. Pipe 29 is attached to housing 21 by means of clips 32 for example. At least in the case of the section 33 which is clear of the housing, the pipe is formed from a flexible material for a length at least sufficient not to hamper the reciprocating movement in the housing 21.

Two take-up rollers 15 and 16 are intended to draw the sliver 17 to be treated from the storage area 18. The form of storage may be of any type (in reels, cakes, etc.) or there may even be no storage if the treatment takes place after other continuous operations. Roller 15 is driven by a motor (not shown), and the other roller is mounted to rotate freely on its axis. The free roller 16 is pressed against the driven roller 15 by a spring 19, which removes any damage of breakage if the sliver contains irregularities. Between the storage area 18 and the take-up rollers 15 and 16 is situated a schematically shown device 20 which is intended to stop the infeed device when it detects a break in the sliver. Such a monitoring device is conventional and therefore need not be described here.

The downstream end of the treatment enclosure contains an opening 34 from which the treated sliver is withdrawn. In order that withdrawal may be easy, it is necessary to prevent the material from turning over as it would if the enclosure had a second vertical arm and it must be withdrawn directly from the point where it leaves the horizontal section. What is more, the sliver should not be pulled out vertically but instead at a considerable angle to the vertical and preferably horizontally. The take-up means and the other parts of the installation may be arranged horizontally at the outlet from the horizontal section of the enclosure. However, it is possible that a partly vertical arrangement as shown in FIG. 1 may be preferable to cut down the amount of space taken up. Rollers 35 and 36 are wringing rollers. Roller 35 is driven round by a variable-speed motor 37 and roller 36 is mounted to rotate freely about its axis and is pressed against roller 35 with a force appropriate to the required thoroughness in wringing. A sump 38 is located under the wringing rollers. The liquid which is collected is discharged through pipe 39. This pipe contains a valve 40 which makes it possible for the liquid collected to be fed on either for recycling, via pipe 41, or for disposal, via pipe 42, or partly for recycling and partly for disposal. The function of this arrangement will be explained below.

Figure 4:
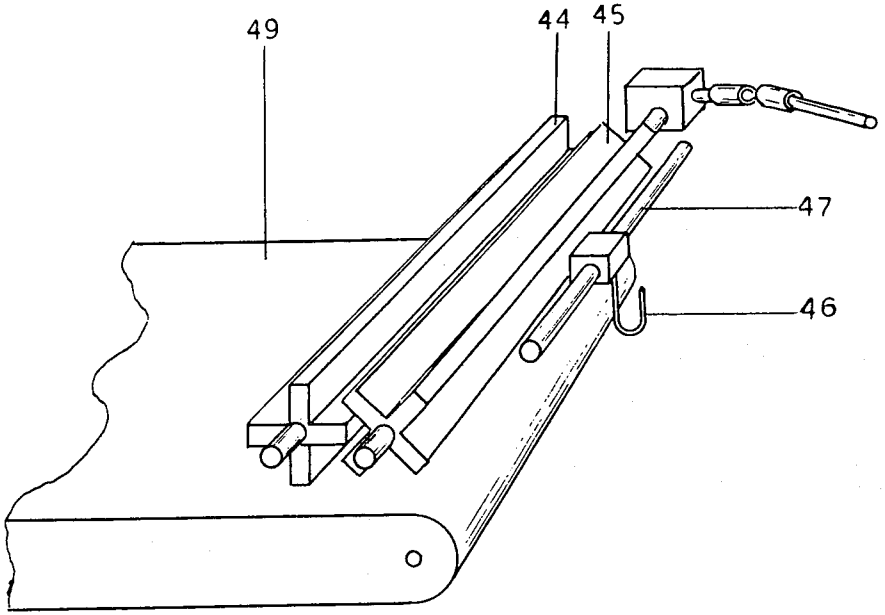
FIG. 4 is a perspective view of the take-up device 43 shown in FIG. 1.

Take-up device 43, which is shown in more detail in FIG. 4, is formed by two identical ridged rollers 44 and 45 which are also driven round by motor 37. As shown they are of cruciform shape but any other similar configuration could be adopted.

They are so arranged that the ridges and grooves interengaged. They thus exert not a constant tension on the sliver but rather a constant applied thrust, due to the friction of the sliver against the ridges. The ridged form also makes it possible for any danger of the sliver winding itself around the rollers to be removed. A fork 46 which performs a similar function to that of fork 27 moves back and forth along shaft 47, being driven by a motor which is not shown. The wringing and take-up arrangements as a whole are surrounded by a closed casing 48.

Downstream of the take-up device 43 is situated an endless conveyor belt 49 which passes through an oven 50. Since such ovens are perfectly standard in the textile industry the oven is not shown in detail. At the outlet from the oven is a reception device 51 which may be of any suitable type which forms reels, into cakes, etc.

The supply and recycling apparatus for the treating liquid is not shown as it may be of any conventional type. Like the treatment enclosure it too may be insulated if necessary.

At different points in the installation are situated ducts 52 which open to the exterior and which allow the vapours which maay form during treatment to be discharged. In particular a duct 53 is located above oven 50. The vapours are then fed either into the surrounding atmosphere or to an incinerator where they are burnt.

The way in which the installation operates is as follows: the sliver 17 to be treated, which is stored at 18, is taken up by rollers 15 and 16. Device 20 checks the sliver and halts take-up as soon as it detects a break.

The sliver then runs over roller 12. Fork 27 imparts to it a reciprocating movement along roller 12 and then guides it into sleeve 25, through which it enters housing 21. It passes between rollers 23 and 24 and then through hollow member 28. The treating liquid, which arrives through pipe 29, is sprayed onto the sliver by the nozzles inside member 28. Such an arrangement allows very uniform impregnation.

The sliver is then laid down in a zig-zag in enclosure 2 by virtue of the action of take-up rollers 23 and 24 and the reciprocating movement of housing 21. It is important that the cross-sectional dimensions of the enclosure should be matched to the product to be treated: the lengthwise distance over which the reciprocating movement takes place should be considerable so as to give the treatment chamber a high capacity, but the width should be small as to allow a regular build-up and to prevent any tangling which would make it difficult for the sliver to be withdrawn. The overall length of the enclosure is calculated as a function of the desired duration of contact between the material and the treating liquid and of the speed at which the material is fed in. The sliver sinks through the vertical section 2 of the enclosure under its own weight plus that of the treating liquid with which it is impregnated. The anti-friction material from which the radiused section 4 is made makes it easier for the material to pass into the horizontal section 3. At this point the perforated wall 5 provides initial drainage and the liquid recovered, which is virtually pure, may be recycled in its entirety.

The sliver is then drawn out of the enclosure and wrung by rollers 35 and 36. The liquid which is recovered in this area may contain, depending on the product being treated and the conditions of treatment, a not inconsiderable proportion of other matter, such as the water with which the sliver was impregnated before being treated. It is for this reason that provision is made for total recycling if the percentage concerned is negligible or for no recycling if it is high, or for partial recycling if it is low. The recycling ratio is regulated by means of valve 40.

The sliver is then taken up by device 43 and lowered onto the conveyor 49. The sliver contains irregularities such as variations in diameter or density and thus reacts in an irregular fashion to the treatment, by contracting to a greater or lesser degree for example. When such changes take place between rollers 35 and 36 and device 43, in which area the sliver is still partially impregnated, it can be seen that the nature of device 43 will nevertheless allow the take-up to be properly uniform and will allow breaks in the sliver to be prevented, which would call for the installation to be stopped and for action to be taken which might be hampered by the treating medium.

The sliver then passes through oven 50 and the remaining liquid is removed by evaporation. Duct 53 allows the vapour to be taken away either to a condenser or to an installation where it is burnt, assuming that it cannot be released directly into the atmosphere. The dry sliver is then extracted from the oven and put into a form suitable for its future use. It could even be fed directly to an installation which carried out some further continuous treatment.

Such an installation makes it possible to solve the special problems which arise in treating material in the form of slivers or rovings of fibres with a liquid, and in particular in treatment which needs to take place on a product while it is not under tension in order to assist any shrinkage which might be necessary. It is particularly suitable for treating slivers or rovings of cellulose materials with liquid ammonia, these being such as slivers of cotton or viscose or of natural polyamide materials such as wool. In this event it is necessary for the whole of the installation to be insulated since the treatment takes place at a temperature of less than −34° C, which is the boiling point of ammonia at atmospheric pressure.

A 10g/m sliver of raw cotton, which was in fact formed by combining two slivers, each of 5g/m, and which emerged directly from a doubling apparatus, was treated. At a speed of 38m/min, the sliver was fed into a treatment enclosure the cross-sectional dimensions of which were 1 m. across by 0.15 m. wide and the length of which was approximately 5 m. Approximately 900 liters/hour of liquid ammonia were fed in. It is true that such a quantity is very much greater than that required to achieve the full effect on the sliver but it gives excellent impregnation and thus ensures uniform treatment, and also it helps the sliver to make its way through the enclosure as a result of the increase in weight it provides. Furthermore, it makes it possible for the sliver already contained in the enclosure to be sprayed to an additional extent from the impregnation nozzles. The sliver was withdrawn at a speed of 35 m/min, after a time under treatment which may vary depending on the desired results but which is between 2 mins and 2 hours. A speed of withdrawal slower than that of infeed allows the material to shrink freely during the time when it is in contact with the liquid ammonia. After wringing there was still about 40% by weight of liquid ammonia in the sliver. This residual ammonia was evaporated while the sliver was passing through the oven, where the temperature is held between 20° and 100° C. A more regular silver was obtained, the fibres in which were in a relaxed state. It possessed considerable elasticity, annd its apparent volume was increased by approximately 50%, and its dyeing affinity by approximately 30%. What is more, it was highly supple in the moist state.

Wool in various forms has also been treated with this installation:

Combed slivers (33 g/m and 60 g/m) and combed tops (25 g/m). The time for which the wool remains in the enclosure needs to be longer than 45 minutes. The product obtained then has excellent characteristics.

A sliver of cut polynosic fibres (10 g/m) has better tenacity and cohesion when treated under the same conditions.

A number of examples of treatment with liquid ammonia have been given but the installation may be adapted to other types of treatment where the material needs to be kept in contact with a liquid while in the relaxed state. Various finishing treatments come to mind, such as fireproofing.

What we claim is:

1. An installation for treating textile materials, in the form of slivers or rovings of fibres, with a liquid while in a relaxed state; comprising a treatment enclosure restricted from the free air; in-feed means for feeding the material into said enclosure; means for impregnating the material with the treating liquid within said treatment enclosure; and means for withdrawing the material from the treatment enclosure; said treatment enclosure being formed of a substantially vertical section having an entrance at the top into which the material is fed, which is followed by a substantially horizontal section from which the material is withdrawn; said withdrawal means withdraws the material from the horizontal section in at most a positive oblique direction which makes a considerable angle with the vertical direction; said horizontal section having a bottom formed of a perforated surface to drain the material of the treating liquid; a sump situated below said perforated surface; said in-feed means being formed by a transversely movable housing having two guide sleeves and two take-up rollers for restricting the access of free air to the enclosure; one roller being driven round and the other being mounted to rotate freely and being held pressed against the first roller; said sleeves being shaped to guide the material to and from the rollers and to rest accurately against said rollers thus aiding in the restriction of free air; a closure plate forming the bottom of said housing and sealing the entrance of said enclosure; the means for impregnating the material with treating liquid are nozzles positioned downstream of said in-feed means adjacent the top of said vertical section and arranged around an area through which the material passes so as to impregnate said material with liquid and feed the same into said vertical enclosure;

a section intermediate to said vertical and horizontal sections that is substantially radiused and at least the inner surface of which is an anti-friction material; and wringing rollers positioned beyond said horizontal sectiion for squeezing liquid from said slivers or rovings.

2. An installation for treating textile materials, in the form of slivers or rovings of fibres, with a liquid while in a relaxed state, comprising a treatment enclosure, means for feeding the material into said enclosure, means for impregnating the material with the treating liquid within said treatment enclosure, and means for withdrawing the material from the treatment enclosure; said treatment enclosure being formed of a substantially vertical section into which the material is fed, which is followed by a substantially horizontal section from which the material is withdrawn, said withdrawal means withdraws the material from the horizontal section in at most a positive oblique direction which makes a considerable angle with the vertical direction, said means for feeding in the material being formed by a transversely movable housing and two take-up rollers, one of which is driven round and the other of which is mounted to rotate freely and is held pressed against the first roller, and by a movable closure plate sealing the entrance of said enclosure.

3. An installation according to claim 2, wherein the horizontal section has a bottom formed of a perforated surface, said bottom being constructed to drain the material in the horizontal section of the treating liquid.

4. An installation according to claims 3, wherein the housing includes sleeves above and below the take-up rollers. for guiding the material.

5. An installation according to claim 4, wherein the means for impregnating the material with the treating liquid are nozzles which are regularly distributed about the area in which the material passes through the infeed means.

6. An installation according to claim 3, further comprising a sump under said perforated bottom.

7. An installation according to claim 6, further comprising an intermediate substantially radiused section at least the inner surface of which is an anti-friction material.

8. An installation according to claim 7, further comprising wringing rollers positioned just beyond said horizontal section for squeezing liquid from said slivers or rovings and a sump associated with the wringing rollers positioned to receive liquid released by said rollers enclosure, and means for withdrawing the material from the treatment enclosure; said treatment enclosure being formed of a substantially vertical section into which the material is fed, which is followed by a substantially horizontal section from which the material is withdrawn, said withdrawal means withdraws the material from the horizontal section in at most a positive oblique direction which makes a considerable angle with the vertical direction, said means for feeding in the material being formed by a transversely movable housing and two take-up rollers, one of which is driven round and the other of which is mounted to rotate freely and is held pressed against the first roller, and by a movable closure plate sealing the entrance of said enclosure.

9. An installation according to claim 1, wherein said in-feed means is constructed to reciprocate back and forth transversely relative to the horizontal section of said enclosure.

10. An installation according to claim 9, wherein said enclosure is fully insulated.

11. An installation according to claim 10, wherein said enclosure is fully ducted downstream of said horizontal section to draw off any vapors from said treating liquid.

* * * * *

UNITED STATES PATENT AND TRADEMARK OFFICE

CERTIFICATE OF CORRECTION

PATENT NO. : 3,994,147

DATED : November 30, 1976

INVENTOR(S) : Jean-Paul Dalle et al.

It is certified that error appears in the above-identified patent and that said Letters Patent are hereby corrected as shown below:

In Claim 8, column 8, line 14 after "rollers" insert a period and cancel from "enclosure" to the end of the claim at line 28.

Signed and Sealed this

First Day of March 1977

[SEAL]

*Attest:*

RUTH C. MASON
*Attesting Officer*

C. MARSHALL DANN
*Commissioner of Patents and Trademarks*